United States Patent [19]

Freese

[11] Patent Number: 4,817,825

[45] Date of Patent: Apr. 4, 1989

[54] WATER JET INJECTION DEVICE FOR USE WITH DISPENSERS FOR PRODUCING AND DISPENSING BEVERAGES MIXED OF FRUIT SYRUP OR CONCENTRATE AND WATER

[75] Inventor: Uwe Freese, Lübeck, Fed. Rep. of Germany

[73] Assignee: Dagma Deutsche Automaten- Und Getrankemaschinen GmbH & Co. KG, Rheinfeld, Fed. Rep. of Germany

[21] Appl. No.: 20,374

[22] Filed: Mar. 2, 1987

[30] Foreign Application Priority Data

Mar. 7, 1986 [DE] Fed. Rep. of Germany ..... 3607606

[51] Int. Cl.[4] ..... B67D 5/56

[52] U.S. Cl. ..... 222/129.2; 137/891; 137/895; 222/134; 222/145; 239/570

[58] Field of Search ..... 222/57, 129.1, 129.2, 222/144.5, 145, 559; 239/318, 570, 571; 137/605–607, 895, 888, 889, 893; 417/182, 183, 184

[56] References Cited

U.S. PATENT DOCUMENTS

| | | | |
|---|---|---|---|
| 2,080,075 | 5/1937 | Gilbert | 222/559 |
| 2,756,773 | 7/1956 | Bauerlein | 137/895 |
| 2,785,830 | 3/1957 | Bauerlein | 222/129.2 X |
| 2,785,833 | 3/1957 | Bauerlein et al. | 222/129.2 X |
| 3,007,609 | 11/1961 | Pascucci | 222/129.2 |
| 3,016,916 | 1/1962 | Kraft | 137/889 |
| 3,357,598 | 12/1967 | Kraft | 137/889 X |
| 3,643,688 | 2/1972 | Meinert | 222/145 X |

FOREIGN PATENT DOCUMENTS

| | | | |
|---|---|---|---|
| 1428452 | 1/1969 | Fed. Rep. of Germany | 137/888 |

*Primary Examiner*—Kevin P. Shaver
*Attorney, Agent, or Firm*—Herbert Dubno

[57] ABSTRACT

A water jet injection device for use with mixed beverage dispensing machines is provided, wherein a bushing-type sealing element which fulfills several functions is placed in the injector housing. In particular, the sealing element sealingly separates the mixing chamber from the rearward section of the injector housing in a reliable manner and further acts as a nonreturn valve hermetically sealing the mixing chamber against the supply conduit for fruit syrup or concentrate when the injector in the mixing chamber is inoperative and, at the same time, the sealing element provides a seal when an intake conduit or the like is connected with the lateral intake opening of the injector housing.

13 Claims, 2 Drawing Sheets

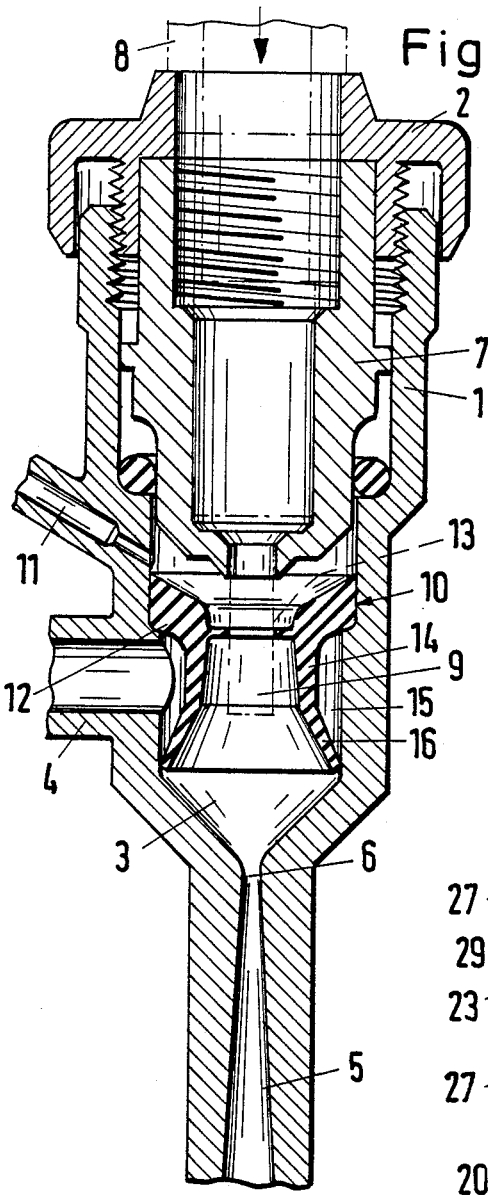
Fig. 1
Fig. 2
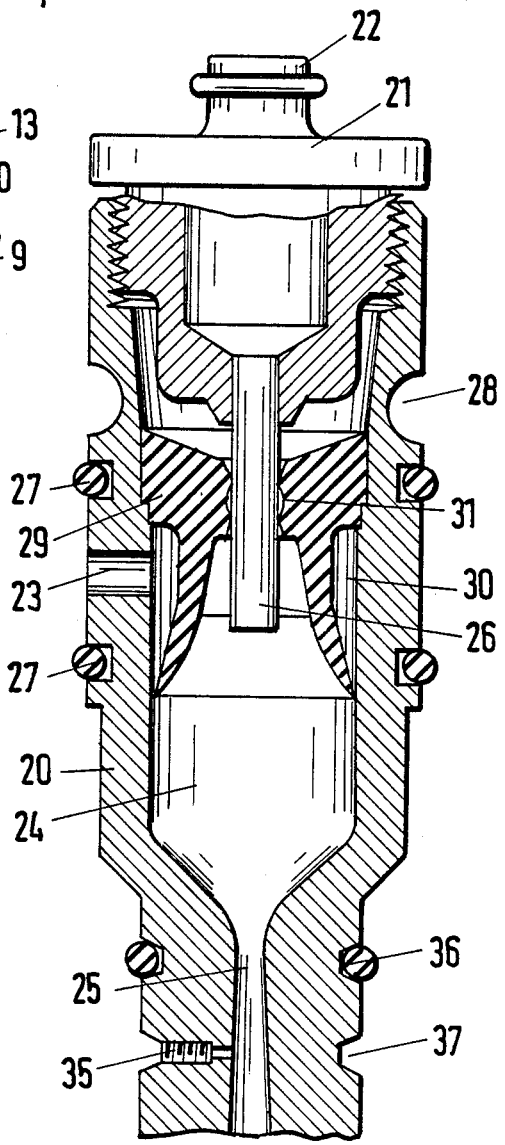

WATER JET INJECTION DEVICE FOR USE WITH DISPENSERS FOR PRODUCING AND DISPENSING BEVERAGES MIXED OF FRUIT SYRUP OR CONCENTRATE AND WATER

FIELD OF THE INVENTION

The present invention relates to a water jet injection device for use with dispensers for producing and dispensing beverages mixed of fruit syrup or concentrate (high-viscosity liquid) and water (low-viscosity liquid). The device is also suitable for the production of, for example, chocolates or soups of paste-like concentrates, or for the admixture of other flowable substances of high solids content with water.

BACKGROUND OF THE INVENTION

To allow the reservoir containing either the fruit syrup, the concentrate or the like to be arranged at a height independent of the height of the mixing chamber and to ensure reliable function and adjusting the conduit supplying the mixing chamber is usually associated with a non-return valve and/or a pressure reducing mechanism. Either a spring-loaded non-return valve, a ball valve or a reducing valve may be employed in this case. This arrangement is relatively time-consuming to fabricate and expensive and difficulties arise from the danger of clogging and with regard to the cleaning which cannot be dispensed with in systems of such type. Despite the comparatively high manufacturing cost a conventional non-return valve can fulfill only one single function, namely can either close or open the supply conduit for syrup or concentrate in dependance upon the pressure conditions which occur.

OBJECT OF THE INVENTION

It is an object of the present invention to provide an improved water jet injection device for the purpose described but constructed so as to avoid the aforementioned drawbacks, simplify the manufacture, extend the range of function of the non-return valve and finally, substantially simplify and improve the conditions when the system is rinsed and cleaned.

SUMMARY OF THE INVENTION

In a water jet injection device for use in dispensers for producing and dispensing beverages, in particular beverages mixed of fruit syrup or concentration and water, comprising an elongated injector housing, in the interior of which a mixing chamber is formed into which a water jet pipe extends from one end of the injector housing which is adapted to be connected to a pressurized source of water and from which a nozzle portion extends for discharge of the mixer at the other end of the injector housing, At least one lateral intake opening is provided for connection with an intake conduit for either the fruit syrup, the concentrate or the like which has associated therewith a nonreturn valve means.

According to the invention, the injector housing has a sealing element of elastic material which includes an elastically yieldable edge portion or lip which, when the injector is in the inoperative state acts as a nonreturn valve and sealingly blocks the lateral intake opening from the mixing chamber and unblocks the intake opening when the injector is in its operative state.

The sealing element of elastically yieldable material and preferably in the form of a bushing is simple and inexpensive in construction. No specific structural measures are required in the area of the supply conduit for fruit syrup or concentrate. Nor does the injector housing required to be of a particular design for installing the sealing element. In the assembled state, the sealing element is capable of reliably fulfilling several functions in the injector housing. For instance, the sealing element can reliably seal the connection betwen the housing and the intake conduit or the mixing chamber against the housing portion facing away from the nozzle portion of the injector housing. No particular further sealing measures are necessary. If the drilled hole desired for the production of specific beverages and used for drawing air into the mixing chamber is provided on the side of the sealing element facing away from the nozzle portion in the injector housing, it will be possible to also provide the sealing element in the area where it sealingly encircles the water jet pipe, in the form of a seal lip having an effect like that of a non-return valve i.e. when there is no vacuum in the mixing chamber the seal lip reliably seals the air intake against the mixing chamber by engagement with the wall of the pipe but opens the air intake as soon as the injector is in sufficient operative state. The mixing chamber as well as all of the parts of the water jet injection device contacting the mixed beverage consequently can reliably be rinsed with pressurized water while, at the same time, both the supply conduit for fruit syrup or concentrate and additionally also the air intake are hermetically sealed against the rinsing operation. A substantially more reliable and more simple rinsing operation results which, if desired, may be also effected as an end phase terminating each individual dosing operation. On the other hand, when the injector is in its operative state, the valve element sufficiently opens the connection between the mixing chamber and the air intake as well as the connection between the mixing chamber and the supply conduit for fruit syrup or concentrate.

When changes in pressure occur during injector operation, for example by clogging of the nozzle portion as a consequence of coarse portions of the trapping of fruit pulp or the like, both air intake and supply conduit are abruptly and reliably blocked by the sealing element acting as a non-return valve. A contamination of the air intake either by syrup, concentrate or mixed beverage consequently is reliably excluded.

The closing effect of the sealing element further prevents the injector housing from draining after the termination of the injector operation.

The sealing element is capable of ensuring a hermetic seal in all operating states between the mixing chamber and the rearward area of the injector housing when the ventilating hole is not formed in said rearward area of the housing but is provided in the nozzle portion of the injector housing in the form of a radial hole of minor cross-section.

In a further embodiment, the sealing element simultaneously forms the seal for the connection between injector housing and supply conduit for fruit syrup. The sealing element can then have a ring wheel-shaped sealing portion for this point of connection, a center portion adapted to be inserted into a connection of the injector housing and a frustoconical lip-type portion which sealingly engages a frustoconical insert member in the intake opening for fruit syrup.

BRIEF DESCRIPTION OF THE DRAWING

The above objects, features and advantages of my invention will become more readily apparent from the following description, reference being made to the accompanying drawing in which:

FIG. 1 is an axial cross section through one embodiment of a dispenser according to the invention;

FIG. 2 is an axial cross section through a second vertical dispenser; and

Figure 3:
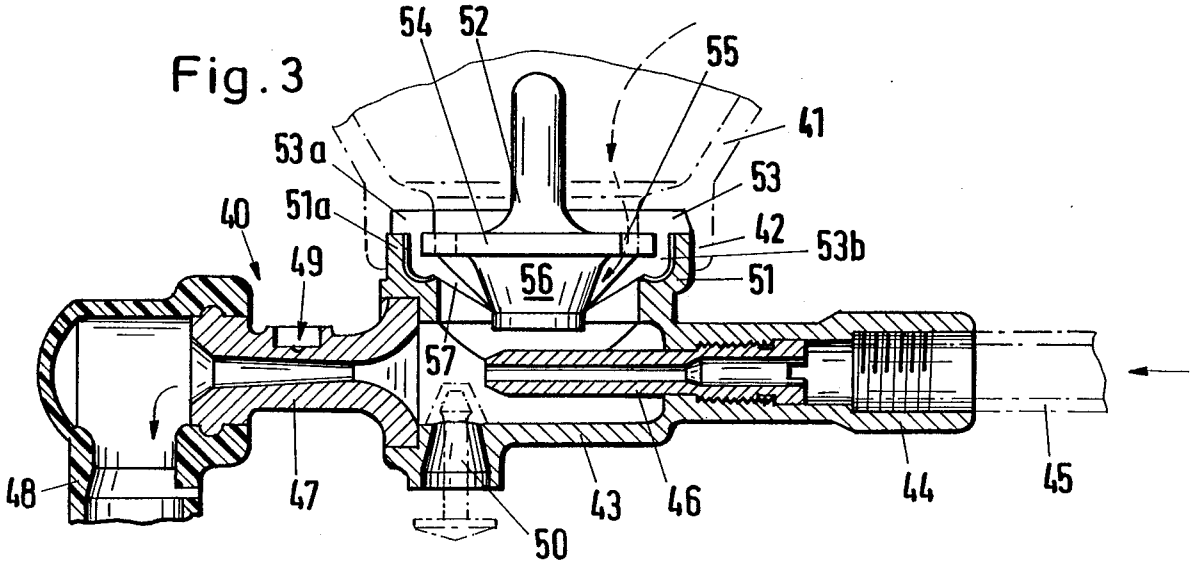
FIG. 3 is an axial section through a third embodiment of the invention.

In accordance with FIG. 1 the water jet injection device has an elongated injector housing 1 having various sections. On the rearward side of larger cross-section the injector housing is closed by means of a cap-shaped cover member 2 adapted for screw threaded engagement with the housing. Cover member 2 is connected to a pressurized source of water through a connection conduit 8. Attached to cover member 2 is an element 7 which is movable in the injector housing in piston-type fashion, is sealed through a slide seal in the form of an O-ring and carries at the lower end thereof a water jet pipe 9 centrally positioned in the injector housing 1 and terminating in a mixing chamber 3 of the injector housing. The position of the mouth of the water jet pipe 9 opening into the mixing chamber optionally can be varied by screwing cover member 2 onto injector housing 1, whereby injector action can be initiated. Toward the bottom in FIG. 1, a mixing chamber 3 is provided with a nozzle portion 5 of venturi-type cross-section, the narrowest point 6 of which is located where the beverage leaves mixing chamber 3. Spaced relation upstream of nozzle portion 5 is a connecting piece 4 for supply of fruit syrup or concentrate which opens laterally into injector housing 1. The supply conduit is connected to a storage vessel which can disposed at either a higher or lower level with respect to the mixing chamber 3. Spaced above the connecting piece 4 is a ventilating hole 11 through which the interior of injector housing 1 freely communicates with the exterior.

A bushing-type sealing element 10 of elastically yieldable sealing material is inserted into the injector housing. The sealing element 10 has a cylindrical rearward portion 12 of larger cross-section which is biased and in engaging relation with a housing shoulder. A sealing lip 16 of element 10 frustoconically extends toward and sealingly cooperates with the inner surface (annular wall) of the injector housing and through a lip-shaped sealing portion 13 also sealingly cooperates with the water jet pipe 9. The sealing element 10 thus sealingly separates the mixing chamber from the rearward area of the injector housing 1 and through the seal lip 13 acting as a non-return valve also seals the air intake 11 against the mixing chamber 3. The cylindrical portion 12 is provided with a tapered externally cylindrical section 14 of reduced cross-section which together with the inner surface of the injector housing 1 forms an annular dispensing chamber 15 which is in free flow communication with the connecting piece 4 for fruit syrup or concentrate. Section 14 is provided with the lip-shaped sealing portion 16 widening outwardly in frustoconical fashion and whose expanded edge sealingly engages the inner surface of injector housing 1 and consequently, sealingly separates the mixing chamber 3 from the annular dispensing chamber and the supply conduit for fruit syrup or concentrate.

The arrangement is such that when the supply of water is stopped and the injector consequently is inoperative, the seal lips 13 and 16, respectively, fulfill their sealing functions. this is also true when an excess pressure occurs in the mixing chamber 3. This may be the case when a rinsing pressure for cleaning the parts contacting the mixed beverage is generated in the mixing chamber 3 by a system not explained in detail here or when, during injector operation, the nozzle portion 5 is clogged with fruit pulp or the like. However, when the water jet issuing into the mixing chamber 3 induces injector action and thus, the generation of a vacuum in the mixing chamber 3, the seal lips formed as non-return valves deflect to bring the mixing chamber 3 into communication with both the annular dispensing chamber and the air intake 11. In case the admixture with air is not desired when the mixed beverage is produced, the air intake 11 will only have to be closed by means of its valve.

In the embodiment shown in FIG. 2 the injector housing 20 includes a connection hole 23 located between a pair of annular seals 27. This connection hole can be brought into communication with a supply conduit for fruit syrup or concentrate. Hole 23 opens into a dispensing chamber 30 which may be sealed against the mixing chamber 24 by means of the lip-shaped non-return portion of the sealing element 29. Water jet pipe 26 is in sealing contact with a sealing portion 31 of sealing element 29 in all possible occurring operating states so that the rearward section of the injector housing 20 is hermetically sealed by the sealing element 29. A plug member 21 can be screwed onto the rearward section, said plug member carrying the water jet pipe 26 and a seal-equipped plug connection 22 for connection with water. In spaced relation from mixing chamber 24 nozzle portion 25 is provided with a radial air intake 35 which extends from an outer annular groove 37. An O-ring 36 can be placed within said annular groove to close the air intake when the admixture with air is not desired during injector operation. O-ring 36 can be safely held in a detent groove other than the group 37 (as shown) when the O-ring is not used to block the air-intake orifice 35.

The arrangement is such that the injector housing can be sealingly inserted into a corresponding sleeve-type accommodating element against which the injector housing can be sealed by means of the annular seals 27 and can be locked by means of a locking member engaging the annular groove 28.

The mode of functioning of the arrangement is similar to that described in the embodiment according to FIG. 1 with the difference that sealing element 29 permanently seals the rearward section of the injector housing 20 and air supply to the mixture is effected through the air intake 35 located in the nozzle portion.

In the embodiment shown in FIG. 3 a water jet pipe 46 extends in the elongated section 43 of the injector housing, the water jet pipe being in communication with the water conduit 45 inserted at the end 44 of the housing. The other end of the elongated housing is provided with a diffuser portion 47 having a predetermined breaking point 47 where, if need arises, an air intake may either be drilled or uncovered. The diffuser opens into a discharge section 48 for the beverage.

The housing has a relatively broad lateral shoulder 51 for connection with the supply conduit or the like. In the present case, the supply conduit for fruit syrup is directly replaced by the lower discharge opening 41 of a syrup container. The center portion 53*b* of a sealing element 53 is inserted into shoulder 51. Center portion 53*b* has a ring wheel-shaped sealing portion 53*a* which when the container 41 and the injector housing are assembled is responsible for sealing the two parts against one another. In the center portion 53*b* of sealing element 53 an insert member is held with the aid of collar 54 which member is provided with two or more partial ring-shaped passage openings 55 for the syrup. Towards the side facing the syrup container, the insert member comprises a displacement portion 52 while on the other side of the collar a frustoconical end piece 56 is provided has an annular wall or surface usually sealingly contacted by an inclined, frustoconical lip-shaped portion 57 of the sealing element. 51*a* designates the connecting section of shoulder 51 and 42 designates the connecting section of the syrup container. Reference numeral 50 represents an element for cleaning purposes which can be operated from outside.

The dynamic water pressure prevailing in the device is increased and ranges between approximately 3.6 and 6 bar when the water enters the water jet pipe and, consequently, a high accuracy is achieved virtually irrespective of changes in viscosity. The adjustment of the mixture strength by means of a reducing mechanism between the storage vessel and the injector housing can be dispensed with. The force applied to press lip-shaped portion 57 (FIG. 3) into engagement with the associated piece is relatively small and, therefore, lip-shaped portion 57 practially has no reducing effect. To regulate mixture strength, the water jet pipe can be longitudinally adjustable, water pre-pressure (before the water enters the water jet pipe) can be varied or by positioning the air intake opening at the injector housing or, by adjusting the flow area of supplied air, the effect of air admixture can be varied. None of these adjusting possibilities necessitates parts contacting either the concentrate or the like and the mixture.

I claim:

1. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high viscosity opening laterally into said chamber and spaced upstream of said outlet passage; and an annular elastic body defining with said wall an annular compartment for said liquid of high viscosity, said body having an outwardly flared annular lip portion tapering and engaging said annular wall between said second inlet passage and said outlet passage, so that said mixing chamber communicates with said compartment upon a deflection of said lip portion, said lip portion forming a nonreturn valve with respect to flow into said compartment from said chamber.

2. The device defined in claim 1 wherein said sealing element is in a form of bushing-type packing.

3. The device defined in claim 1 wherein said outlet passage is in a venturi-type nozzle.

4. The device defined in claim 1 wherein said annular elastic body is formed with a bushing portion seated against a shoulder of said housing and said means forming said first inlet passage includes a water jet tube extending past said bushing into said annular elastic body, said lip portion being connected to said bushing by a hollow cylindrical portion of reduced outer diameter defining said compartment with said wall.

5. The device defined in claim 4 wherein said elastic body is provided with a further lip sealingly engaging said tube, said housing having an air inlet disposed upstream from said elastic body and blocked from communication with said chamber by said further lip in the absence of a high velocity flow from said water jet tube into said chamber.

6. The device defined in claim 5 including means for axially shifting said water jet tube in said housing.

7. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high visocity opening laterally into said chamber and spaced upstream of said outlet passage; and an annular elastic body defining with said wall an annular compartment for said liquid of high viscosity, said body having an outwardly flared annular lip portion tapering and engaging said annular wall between said second inlet passage and said outlet passage, so that said mixing chamber communicates with said compartment upon a deflection of said lip portion, said lip portion forming a nonreturn valve with respect to flow into said compartment from said chamber, said housing being upstream of said elastic body with an air inlet, said first inlet passage including a tube extending into said elastic body, said elastic body being further formed with an inner lip engaging said tube and forming a nonreturn valve permitting air flow from said air inlet along said tube into said chamber.

8. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high viscosity opening laterally into said chamber and spaced upstream of said outlet passage; and an annular elastic body defining with said wall an annular compartment for said liquid of high viscosity, said body having an outwardly flared annular lip portion tapering and engaging said annular wall between said second inlet passage and said outlet passage, so that said mixing chamber communicates with said compartment upon a deflection of said lip portion, said lip portion forming a nonreturn valve with respect to flow into said compartment from said chamber, said elastic body comprising a bushing portion seated against a shoulder formed in said housing, a cylindrical portion of tapered wall thickness connected to said bushing portion and interposed between said lip portion and said bushing portion and a further lip extending inwardly of said cylindrical portion, said first inlet passage including a tube extending into said elastic body and sealingly engaged by said further lip.

9. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high viscosity opening laterally into said chamber and spaced upstream of said outlet passage; and an annular elastic body defining with said wall an annular compartment for said liquid of high viscosity, said body having an outwardly flared annular lip portion tapering and engaging said annular wall between said second inlet passage and said outlet passage, so that said mixing chamber communicates with said compartment upon a deflection of said lip portion, said lip portion forming a nonreturn valve with respect to flow into said compartment from said chamber, said housing being provided with an air inlet passage opening into said outlet passage at the base of an outwardly open circumferential groove, an O-ring receivable in said groove to block said air inlet passage, and a further groove on said housing adapted to receive said O-ring for structuring same where said air inlet passage is to be unblocked.

10. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high viscosity opening laterally into said chamber and spaced upstream of said outlet passage;

an apertured insert member centrally disposed within said second inlet passage; and an annular elastic body surrounding said insert member and partially defining a compartment therewith containing said liquid of high viscosity, said body having a generally frustoconical annular lip portion tapering inwardly and engaging said inset member, so that said mixing chamber communicates with said compartment upon a deflection of said frustoconical portion, said lip portion forming a nonreturn valve with respect to flow into said compartment from said chamber, said elastic body forming a seal between a source of said liquid of relatively high viscosity and said housing and forming the only means effecting pressure reduction between said housing and said source of said liquid of relatively high viscosity.

11. An injection device for proportioning a liquid of relatively high viscosity in the form of fruit syrup or concentrate with a liquid of relatively low viscosity in the form of water and dispensing as a liquid mixture of predetermined proportions of said liquids, comprising:

an elongated injector housing having a major axis and an outlet passage extending along said axis;

means forming a first inlet passage for the liquid of low viscosity, so that said first inlet passage terminates in said housing at a distance from said outlet passage;

means forming a mixing chamber in said housing upstream of said outlet passage and having an annular wall extending along said axis;

means forming a second inlet passage for the liquid of high viscosity opening laterally into said chamber and spaced upstream of said outlet passage;

an apertured insert member having at least two openings centrally disposed within said second inlet passage; and an annular elastic body surrounding said insert member and partially defining a compartment therewith containing said liquid of high viscosity, said body having a generally frustoconical annular lip portion tapering inwardly and engaging said insert member, so that said mixing chamber communicates with said compartment upon a deflection of said frustoconical portion, said lip portion forming a nonreturn valve with respect to flow into said compartment from said chamber.

12. The device defined in claim 11 wherein said insert member comprises a collar with said at least two openings communicating with said compartment.

13. The device defined in claim 11 wherein said insert member comprises a collar provided with said at least two openings communicating with a container for said fruit syrup or concentrate and sealingly engaged in an inwardly open annular groove of said annular elastic body.

* * * * *